US006408954B1

(12) United States Patent
Price et al.

(10) Patent No.: US 6,408,954 B1
(45) Date of Patent: Jun. 25, 2002

(54) GRIPPING MECHANISM FOR A DIRECTIONAL DRILLING MACHINE

(75) Inventors: Trail Price, Monroe; Scott Rempe, Pella, both of IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/602,796

(22) Filed: Jun. 23, 2000

(51) Int. Cl.[7] ..... E21B 19/00; E21B 19/20

(52) U.S. Cl. ..... 175/52; 175/85; 414/22.51; 414/22.62

(58) Field of Search ..... 175/62, 85, 122, 175/52; 414/22.51, 22.62, 22.63, 745.1, 795.2, 910; 198/444; 81/57.2, 57.33

(56) References Cited

U.S. PATENT DOCUMENTS

| | | | | |
|---|---|---|---|---|
| 4,632,618 A | | 12/1986 | Issakainen | |
| 5,458,454 A | * | 10/1995 | Sorokan | 414/786 |
| 5,556,253 A | | 9/1996 | Rozendaal et al. | |
| 5,607,280 A | | 3/1997 | Rozendaal | |
| 5,687,804 A | | 11/1997 | Lappalainen et al. | |
| 6,085,852 A | | 7/2000 | Sparks et al. | |
| 6,179,065 B1 | * | 1/2001 | Payne et al. | 175/24 |
| 6,270,136 B1 | * | 8/2001 | Dagenais | 294/88 |
| 6,298,927 B1 | * | 10/2001 | Back | 166/77.51 |
| 6,332,502 B1 | * | 12/2001 | Mills et al. | 175/52 |

FOREIGN PATENT DOCUMENTS

EP 0 984 132 A2 3/2000

OTHER PUBLICATIONS

Vermeer Manufacturing Company's 1995 D–50 Navigator Parts Manual (undated).
Vermeer Manufacturing Company's 1996 D24/40 Navigator Parts Manual (undated).
Exhibit A: pp. 35–11 to 35–13 of Vermeer Manufacturing Company's 1996 D24/40 Navigator Operator's Manual (undated).
Exhibit B: Drawing showing exploded view of a rod selector used on Vermeer Manufacturing Company's D24/40A Navigator. (undated).

* cited by examiner

*Primary Examiner*—David Bagnell
*Assistant Examiner*—Daniel P Stephenson
(74) *Attorney, Agent, or Firm*—Merchant & Gould P.C.

(57) ABSTRACT

A horizontal directional drilling machine including a rod transfer member having a rod retainer that is movable between a first position and a second position. When the rod retainer is in the first position, the rod retainer is adapted to retain a pipe on the transfer member. By contrast, when the rod retainer is in the second position, a rod can be moved from the transfer member without being obstructed by the rod retainer. A sensor is provided for detecting when a pipe is positioned on the pipe transfer member, and for causing the rod retainer to automatically move from the second position to the first position when a rod is detected.

10 Claims, 18 Drawing Sheets

128
144
138
590
531
536
160
571
577
120

128
dimension x
138
590
536
160
120
571
577
124

GRIPPING MECHANISM FOR A DIRECTIONAL DRILLING MACHINE

FIELD OF THE INVENTION

The present invention relates generally to underground drilling machines. More particularly, the present invention relates to rod loaders for feeding rods to and from horizontal directional drilling machines.

BACKGROUND OF THE INVENTION

Utility lines for water, electricity, gas, telephone and cable television are often run underground for reasons of safety and aesthetics. Sometimes, the underground utilities can be buried in a trench that is later back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string (i.e., a length of interconnected rods) about its longitudinal axis. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. During drilling, drilling fluid can be pumped through the drill string, over a drill head (e.g., a cutting or boring tool) at the end of the drill string, and back up through the hole to remove cuttings and dirt. After the drill head reaches a desired depth, the drill head is then directed along a substantially horizontal path to create a horizontal hole. After the desired length of hole has been drilled, the drill head is then directed upwards to break through the ground surface. A pull-back sequence is then initiated. During the pull-back sequence, a reamer is attached to the drill string, and the drill string is pulled back through the hole. As the drill string is pulled back, the reamer enlarges the hole. It is common to attach a utility line or other conduit to the drill string so that it is dragged through the hole along with the reamer.

A typical horizontal directional drilling machine includes a rod box (i.e., a rack or magazine) for storing rods (i.e., pipes or other elongated members) used to make the drill strings. A rod transfer mechanism is used to transport rods between the drive mechanism of the directional drilling machine and the rod box. During a drilling sequence, the rod transfer mechanism transports rods from the rod box to the drive mechanism. During a pull-back sequence, the rod transfer mechanism transports rods from the drive mechanism back to the rod box.

U.S. Pat. No. 5,607,280 discloses a prior art rod handling device adapted for use with a horizontal directional drilling machine. As shown in FIG. 1, the rod handling device includes a rod box 24 having five vertical columns 41–45. Bottom ends of the columns 41–45 are open so as to define five separate discharge openings 41*a*–45*a* through which rods can be fed. A selection member 50 is mounted beneath the discharge openings 41*a*–45*a*. The selection member 50 has five pockets 41*b*–45*b*, and functions to index or feed rods 20 to and from the rod box 24. For example, during a drilling sequence, the selection member 50 indexes rods 20 from the rod box 24 to a pickup location where the rods are individually picked up and carried to a rotational drive head 16 of the drilling machine by a transfer arm 51. During a pull-back sequence, the transfer arm 51 carries rods 20 from the rotational drive head 16 back to the pickup location, and the selection member 50 indexes the rods from the pickup location back beneath the rod box 24. To move the rods from the selection member 50 back into the rod box, a lift is used to push pipes upwardly into the columns 51–54 of the rod box 24.

During a typical drilling sequence, the rod box is unloaded starting with column 45. After column 45 has been unloaded, column 44 is unloaded. Thereafter, column 43, column 42 and column 41 are sequentially unloaded. During a pull-back sequence (i.e., a sequence in which rods are transferred from the drive head 16 back to the rod box 24), the columns are typically sequentially loaded starting with column 45 and finishing with column 41. Once column 45 has been loaded, a block or plug is manually inserted into pocket 45*b* of the selection member 50 to prevent additional rods from being loaded into column 45. Thereafter, column 44 is loaded. Once column 44 has been filled, a plug or block is manually inserted into pocket 44*b* of the selection member 50 to prevent additional rods from being loaded into column 44. Column 43 is then loaded. After column 43 has been loaded, a block or plug is inserted into pocket 43*b* of the selection member to prevent additional rods from being loaded into column 43, and column 42 is loaded. Once column 42 has been fully loaded, a block or a plug is manually inserted into pocket 42*b* of the selection member 50 to prevent additional rods from being loaded into column 42, and column 41 is loaded.

SUMMARY OF THE INVENTION

One aspect of the present invention relates to a horizontal directional drilling machine including a rod transfer member having a rod retainer that is movable between a first position and a second position. When the rod retainer is in the first position, the rod retainer is adapted to retain a pipe on the transfer member. By contrast, when the rod retainer is in the second position, a rod can be moved from the transfer member without being obstructed by the rod retainer. A sensor is provided for detecting when a pipe is positioned on the pipe transfer member, and for causing the rod retainer to move from the second position to the first position when a rod is detected.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Figure 1:
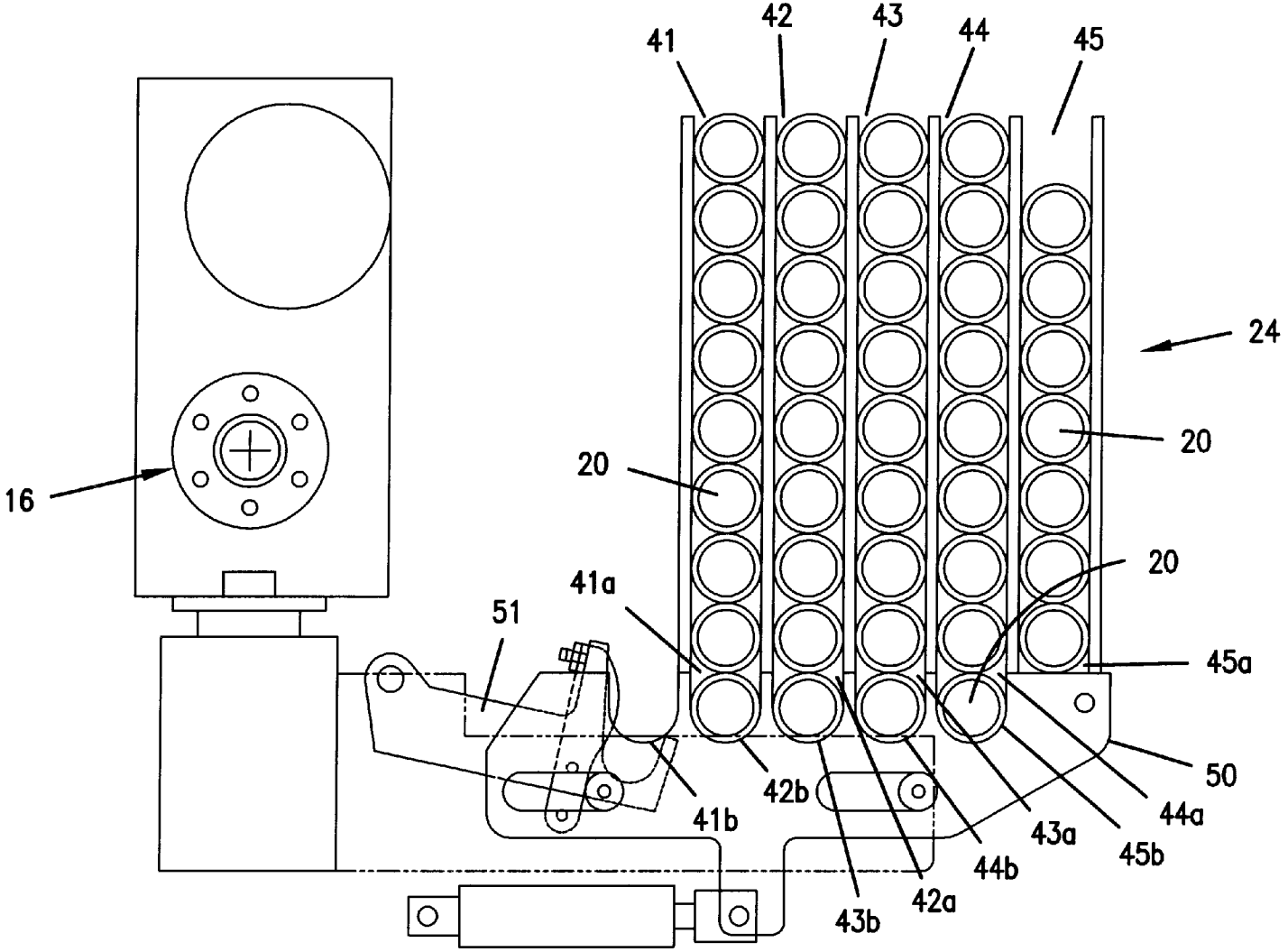
FIG. 1 (Prior Art)
FIG. 1 illustrates a prior art rod handling apparatus.

With reference now to the various drawings in which identical elements are numbered identically throughout, a description of various exemplary aspects of the present invention will now be provided.

I. Rod Transfer Mechanism

FIGS. 2A–2E show a rod transfer mechanism 536 constructed in accordance with the principles of the present invention. The transfer mechanism 536 includes a transfer member 523 in the form a hydraulic cylinder including a cylinder portion 525 and a piston rod or ram portion 527. The ram portion 527 can be extended and retracted relative to the cylinder 525 via hydraulic pressure. In certain embodiments, the transfer member 523 can be pivoted about a pivot axis 529 (e.g., provided by a trunnion mount) by a conventional drive mechanism (not shown) such as a hydraulic cylinder or a drive motor.

The transfer member 523 includes a first rod retainer 531 positioned at the free end of the ram portion 527. The first rod retainer 531 includes a curved partial pocket that defines a rod receiving location 533. While it is preferred for the rod retainer 531 to be curved, it will be appreciated that the rod receiving location can be defined by other types of structures such as one or more straight wall segments.

A second rod retainer 571 is provided for holding or retaining a rod at the rod receiving location 533. The second rod retainer 571 is movable between a first position (shown in FIG. 2A) in which the retainer 571 is adapted to retain a rod at the rod receiving location 533, and a second position (shown in FIG. 2B) in which the rod can be inserted into or removed from the rod receiving location without obstruction from the second rod retainer 571.

Figure 2A:
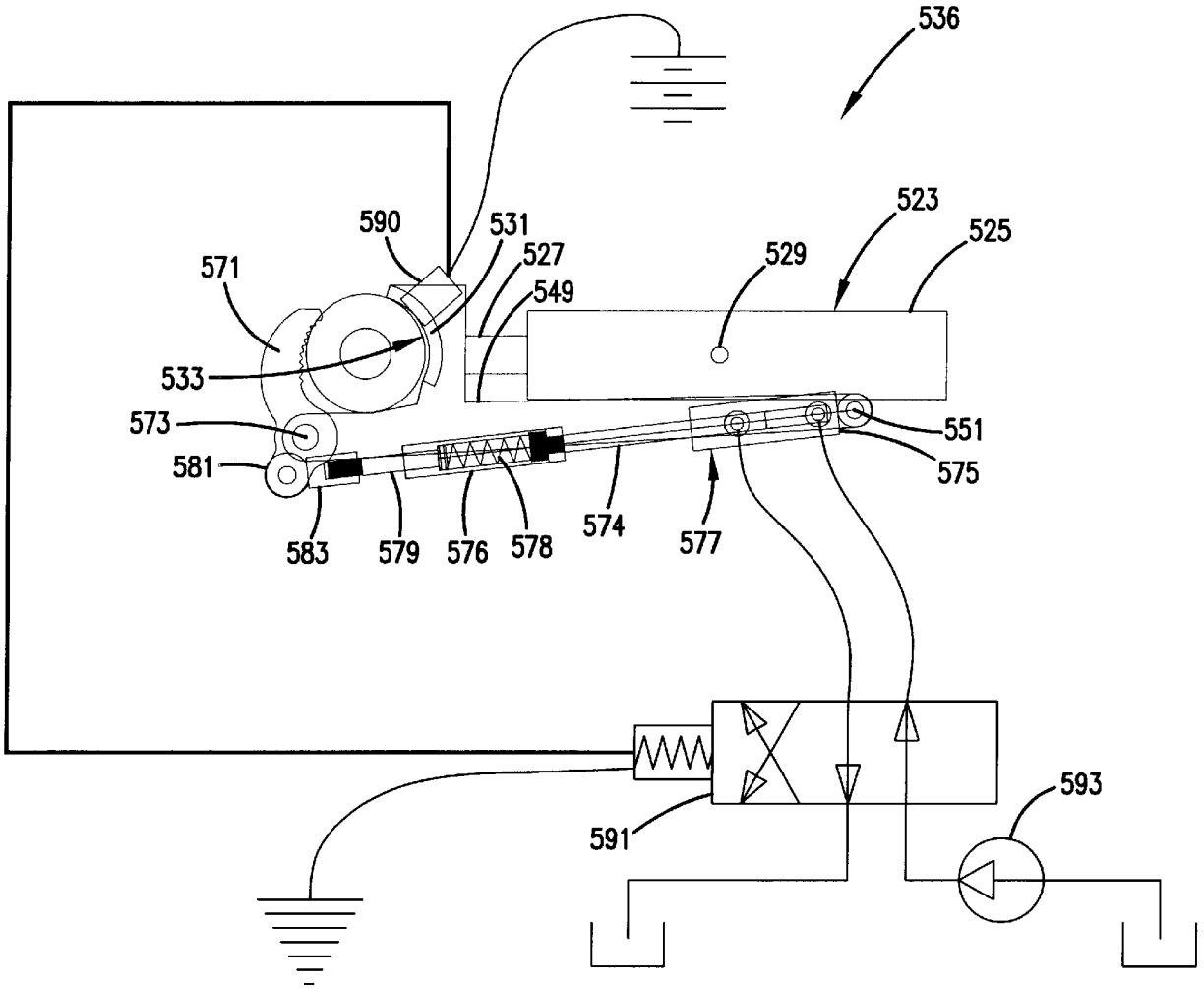
FIG. 2A illustrates a rod transfer mechanism in accordance with the principles of the present inventions, the transfer mechanism is shown in a rod retaining position.
Figure 2B:
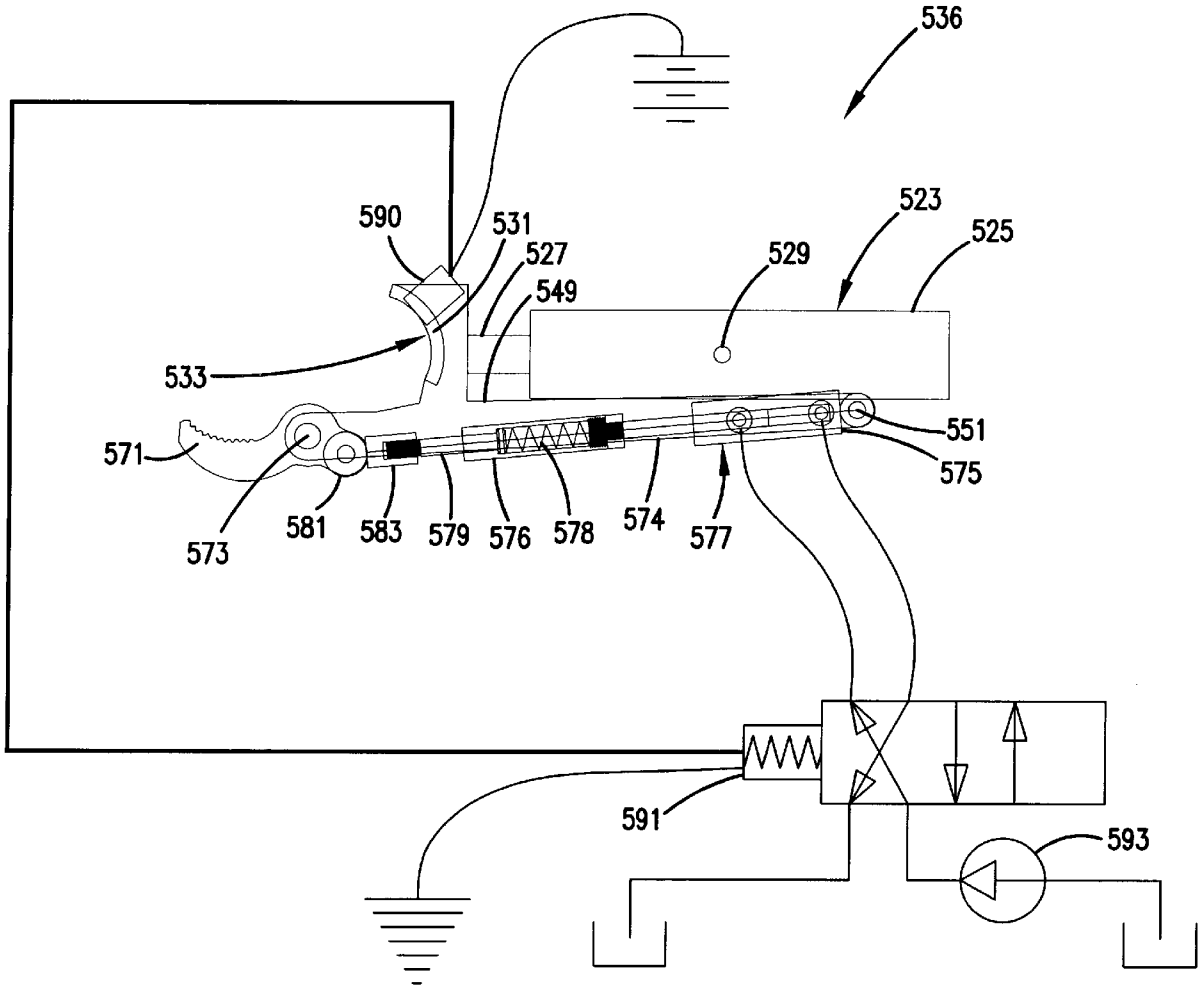
FIG. 2B illustrates the transfer mechanism of FIG. 2A in a non-retaining position.

As shown in FIGS. 2A and 2B, the second rod retainer 571 pivots about a pivot point 573 between the first position (i.e., the retaining or closed position) and the second position (i.e., the non-retaining or open position). The second retainer 571 is moved between the first position and the second position by a drive cylinder 577 (e.g., a hydraulic cylinder). The cylinder 577 includes a piston rod 574 that reciprocates within a cylinder portion 575. By extending the piston rod 574, the second rod retainer 571 is moved toward the first position. By retracting the piston rod 574, the second rod retainer 571 is moved toward the second position.

Figure 2C:
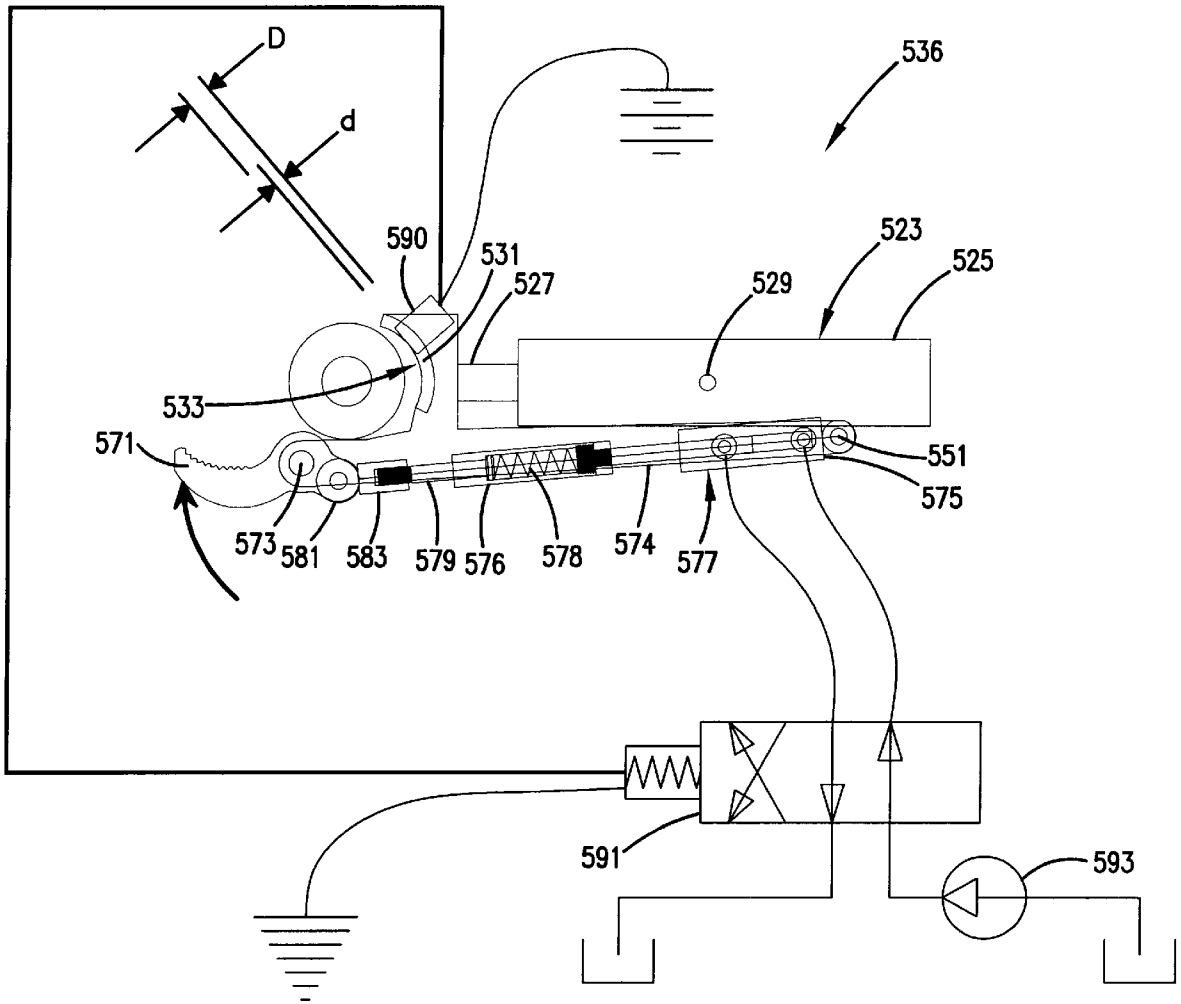
FIG. 2C shows the rod transfer mechanism of FIG. 2A in the process of being pivoted from the non-retaining position toward the retaining position.
Figure 2D:
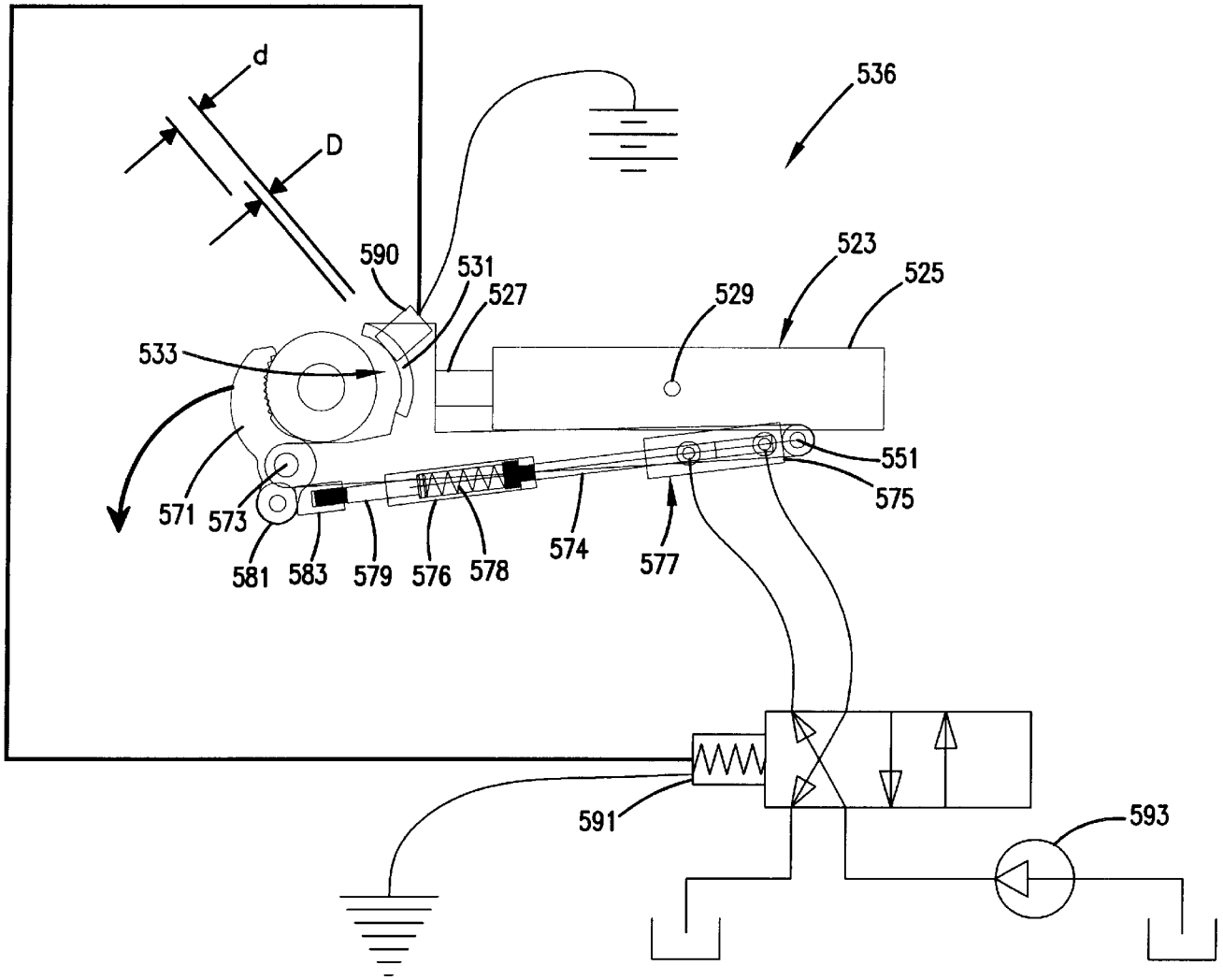
FIG. 2D shows the rod transfer mechanism of FIG. 2A in the process of being pivoted from the retaining position toward the non-retaining position.
Figure 2E:
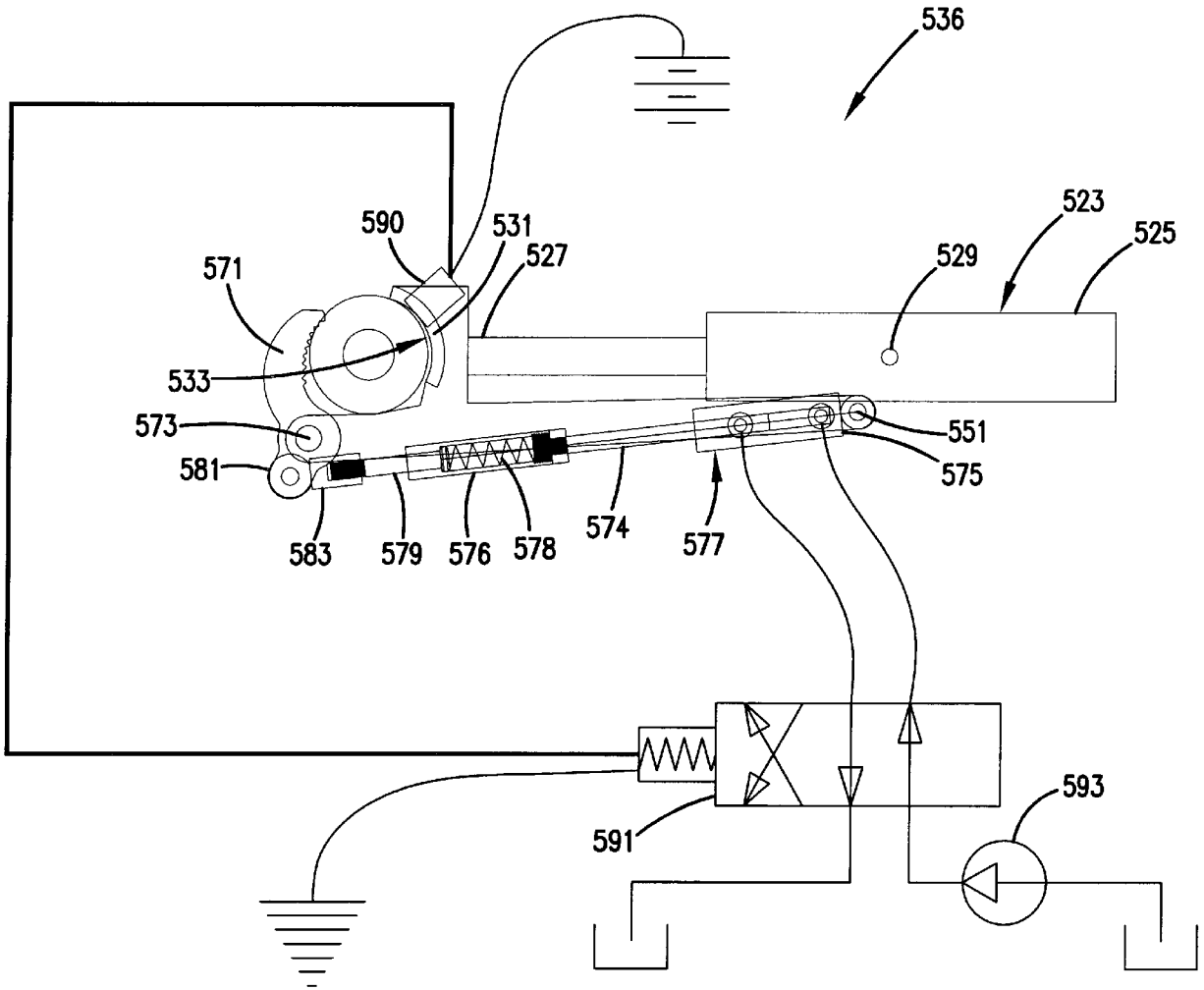
FIG. 2E shows the rod transfer member of FIG. 2A in an extended orientation.

A mount member 549 is shown connected to the ram portion 527 so as to move in concert with the ram portion 527 as the ram portion 527 is moved between a retracted position (see FIGS. 2A–2D) and an extended position (see FIG. 2E). The second rod retainer 571 is connected to the mount member 549 at pivot point 573, and the cylinder portion 575 of the drive cylinder 577 is connected to the mount member 549 at pivot point 551. For clarity, the mount member 549 is shown in FIGS. 2A–2E, but omitted from the remainder of the Figures.

Referring again to FIGS. 2A and 2B, the free end of the rod 574 is coupled to a sleeve 576. A spring 578 is mounted within the sleeve 576. A connector 579 (e.g., a bolt) provides a connection between the sleeve 576 and a lateral extension 581 that projects outward from the second retainer 571. The extension 581 projects radially outward from the pivot axis 573 of the second rod retainer 571 to provide a moment arm. One end of the connector 579 is threaded within a sleeve 583 that is pivotally connected to the lateral extension 581. The other end of the connector 579 includes a head positioned within the sleeve 578. Interference between the head and the sleeve 576 prevents the fastener 579 from being axially pulled from the sleeve 576. The spring 578 biases the connector 579 toward the lateral extension 581. The fastener 579 is free to slide into the sleeve 576 against the bias of the spring 578.

Figure 3B:
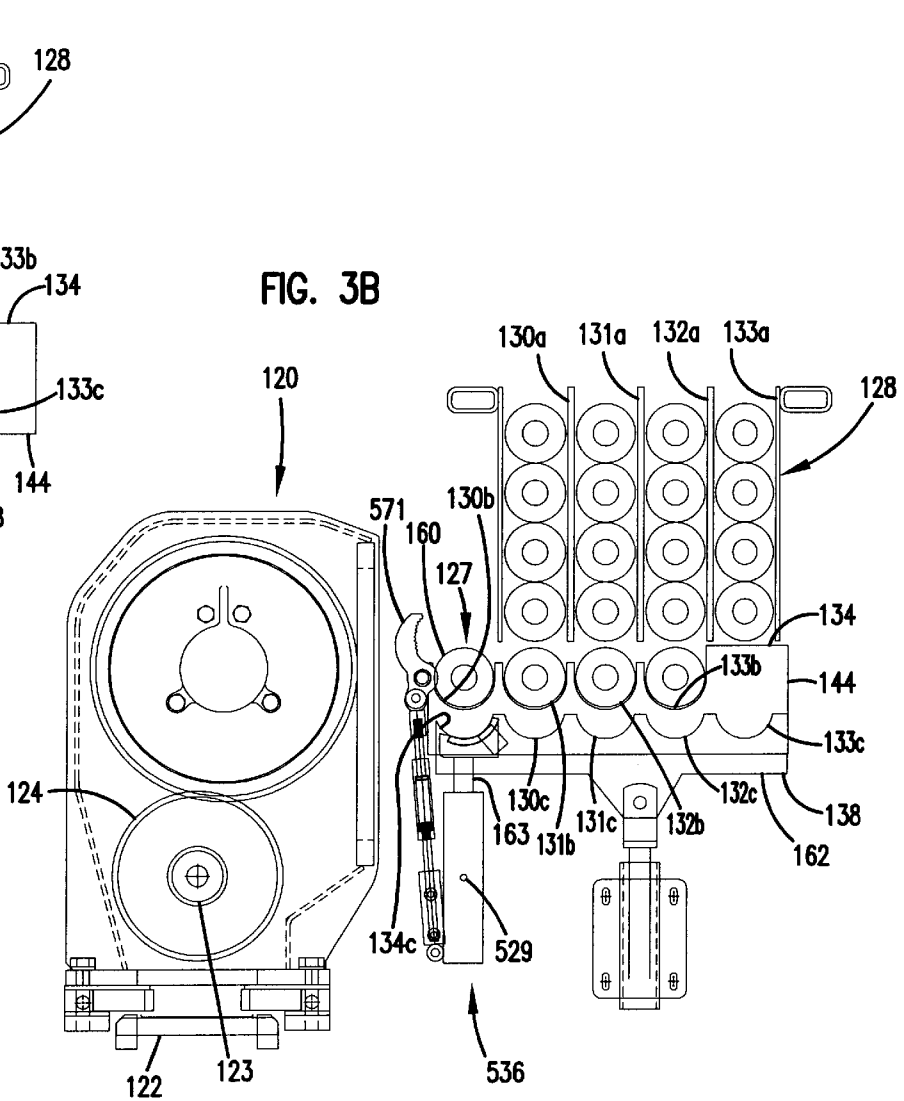
FIGS. 3A–3L illustrate a sequence for moving a rod from a rod box to rotational driver of a directional drilling machine.

FIG. 2D shows the second retainer 571 pivoted from the first position to an intermediate position located between the first and second positions. When the second retainer 571 moves from the first position (shown in FIG. 2A) to the intermediate position (shown in FIG. 3B) while the piston rod 574 remains stationary, the connector 579 slides axially within the sleeve 576 against the bias of the spring 578. In this manner, the sleeve 576 and spring 578 arrangement provides a limited amount of "play" for accommodating movement of the second retainer 571 independent of whether the cylinder 577 has been actuated. The sleeve 576 and spring 578 arrangement also functions to bias the second retainer 571 toward the first position.

It will be appreciated that other configurations could also be used for providing the limited range of movement. For example, a variety of different linkages incorporating springs (e.g., leaf springs, torsion springs, coil springs, elastomeric structures, etc.) or other resilient structures (i.e., structures having elastic characteristics) could be operatively connected between the actuator (e.g., the hydraulic cylinder 577) and the second retainer 571. The phrase "operatively connected between" is understood by those of skill in the art to mean that the resilient structure can be: 1) connected directly between the actuator and the rod retainer; 2) incorporated as part of an assembly, linkage or other arrangement of parts providing a connection between the actuator and the retainer; or 3) formed as an integral part of either the second retainer 571 (e.g., the retainer itself could be flexible) or the actuator. Further, a relief valve setting that controls the extension/compression of the cylinder could also be used.

The rod transfer mechanism 536 also includes a sensor 590 (e.g., a proximity sensor, pressure sensor, mechanical contact switch, etc.) for detecting when a rod is located at the rod receiving location 533 of the rod transfer member 523. In one non-limiting embodiment, the sensor 590 may be an electronic proximity sensor. Alternative sensors can also be used, and the sensor need not be electronic. For example, the sensor could comprise a spring biased lever or other member that when contacted by a rod moves to a position in which a valve (e.g., a hydraulic valve) is actuated. Also, sensors for monitoring or detecting the position of the second retainer 571 could also be used.

The sensor 590 is preferably used to control whether the second retainer 571 is in the retaining position or the non-retaining position. In one embodiment, the sensor 590 detects when a rod enters the receiving location 533 and causes the cylinder 577 to move the second retainer 571 to the retaining position. For example, the sensor 590 can include an integral switch or other controller that is electrically connected to a solenoid valve 591 for controlling hydraulic fluid flow between a pump 593 and the cylinder 577. When a rod is detected by the sensor 590, the sensor 590 causes the solenoid valve 591 to be energized and to move to the position of FIG. 2C. With the valve so positioned, hydraulic pressure causes the piston rod 574 to extend thereby moving the second retaining member 571 toward the retaining position.

As long as the sensor 590 detects the rod, the cylinder 577 stays extended and the second retainer 571 retains the rod adjacent the rod receiving location 533. However, if the rod is moved a sufficient distance away from the sensor 590, the sensor will no longer detect the rod and will cause/signal the solenoid 591 to be de-energized and to move to the position of FIG. 2D. With the solenoid so positioned, hydraulic pressure causes the piston rod 574 to retract such that the second retainer 571 is moved toward the non-retaining position.

The distance from the rod receiving location 533 to the location at which the sensor 590 can no longer detect the presence of a rod can be referred to as the "effective sensing distance" D. In certain embodiments, the distance D can be about ⅜ inch, but it will be appreciated that longer or shorter distances could also be used. The limited range of movement provided to the second retainer 571 by the sleeve 576 and spring 578 arrangement is preferably related to the effective sensing distance D. For example, the distance D (shown in FIGS. 2C and 2D) is preferably equal to or less than the range of movement of the second retainer 571. Thus, if a rod retained adjacent the rod receiving location 533 is pressed against the second retainer 571 with sufficient force to overcome the bias of the spring 578 and move the second retainer 571 to the intermediate position of FIG. 2D (where the rod has been displaced a distance d which is greater than the distance D), the rod moves outside of the range of detection provided by the sensor 590. When this occurs, the cylinder 577 is caused to pivot the second retainer 571 to the non-retaining position. By contrast, when d is less than D as shown in FIG. 2C, the second retainer 571 is pivoted to the retaining position.

II. Directional Drilling Machine

FIGS. 3A–3L and 4A–4L illustrate one type of directional drilling machine 120 on which the rod transfer mechanism 536 of FIGS. 2A–2E could be used. The directional drilling machine 120 includes an elongated guide or track 122 that can be positioned by an operator at any number of different oblique angles relative to the ground. A rotational driver 124 (i.e., a drive head) is mounted on the track 122. The rotational driver 124 is adapted for rotating a drill string (i.e., a string of interconnected rods) in forward and reverse directions about a longitudinal axis of the drill string. The rotational driver 124 includes a drive chuck 123 for connecting the rotational driver to the drill string. Gripping units (e.g., vice grips or wrenches) can be provided adjacent the track 122 for use in coupling and uncoupling rods to the drive chuck 123. A thrust mechanism (not shown) is provided for: 1) pushing the rotational driver 124 down the track 122 to push a drill string into the ground during drilling operations; and 2) pulling the rotational driver 124 up the track 122 to pull a drill string from the ground during reaming/pull-back operations.

It will be appreciated that the above-described components (i.e., the track 122, the rotational driver 124, the gripping units, the thrust mechanism and the drive chuck 123) are well known in the art and can have any number of different configurations. Exemplary prior art machines including such components are manufactured by Vermeer Manufacturing Company of Pella, Iowa.

The horizontal directional drilling machine 120 also includes a removable rod box 128 (i.e., a magazine or rack) for storing the drilling rods. The rod box 128 defines four separate vertical rod storage columns 130*a*–133*a*. Each of the columns 130*a*–133*a* has an open lower end for allowing rods to be discharged from the rod box 128 and/or for allowing rods to be loaded back into the rod box 128. While four columns have been shown, it will be appreciated that the number of columns can be varied without departing from the principles of the present invention.

The directional drilling machine 120 further includes an indexing apparatus for feeding rods to and from the rod box 128. The indexing apparatus preferably includes two identical, spaced-apart feed members 144 (only one shown) positioned beneath the rod box 128. In FIGS. 3A–3L and 4A–4L, the second feed member is hidden behind the depicted feed member 144. For ease of description, only the depicted feed member 144 will be referenced throughout the remainder of the specification.

The feed member 144 (i.e., selection member, indexing member, etc.) includes a plurality of upwardly opening pockets. Preferably, the number of pockets provided on the feed member 144 is equal to the number of columns provided in the rod box 128. For example, as shown in FIGS. 3A–3L and 4A–4L, the feed member 144 includes four pockets 130*b*–133*b* corresponding to the four columns 130*a*–133*a* of the rod box 128. The pockets 130*b*–133*b* are sized for receiving and holding rods. The feed member 144 also includes a blocking element 134 positioned adjacent to the pocket 133*b*. The blocking element can also be a separate piece mounted within or alongside the feed member 144.

The feed member 144 is preferably reciprocated back and forth beneath the rod box 128 (e.g., by a drive mechanism such as a hydraulic cylinder, rack-and-pinion drive, belt or chain drive, etc.) to: 1) feed rods out from beneath the rod box 128 during drilling operations; and 2) feed rods back under the rod box 128 during pull-back operations. The feed member 144 is preferably movable between a first position (shown in FIG. 3A) in which the pockets 130*b*–133*b* are respectively located beneath columns 130*a*–133*a*, and a second position (shown in FIG. 3B) in which the feed member 144 has been displaced one column width to the left. In the second position, the pocket 130*b* is laterally spaced from beneath the magazine 126 so as to be located at a "staging" or "pick-up" location 127.

The directional drilling machine 120 further includes a pair of identical lifts 138 (only one shown) for raising and lowering the rods located within the columns 130*a*–133*a* of the rod box 128. In FIGS. 3A–3L and 4A–4L, the second lift is hidden behind the depicted lift 138. For ease of description, only the depicted lift 138 will be referenced throughout the remainder of the specification.

Figure 3A:
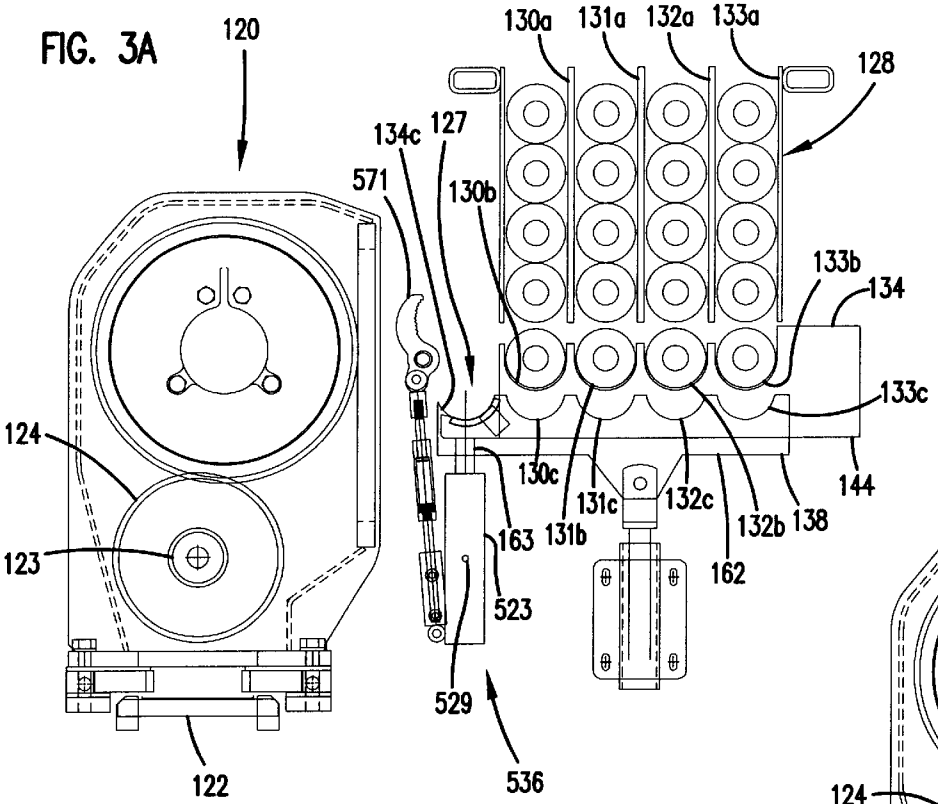
Figure 3D:
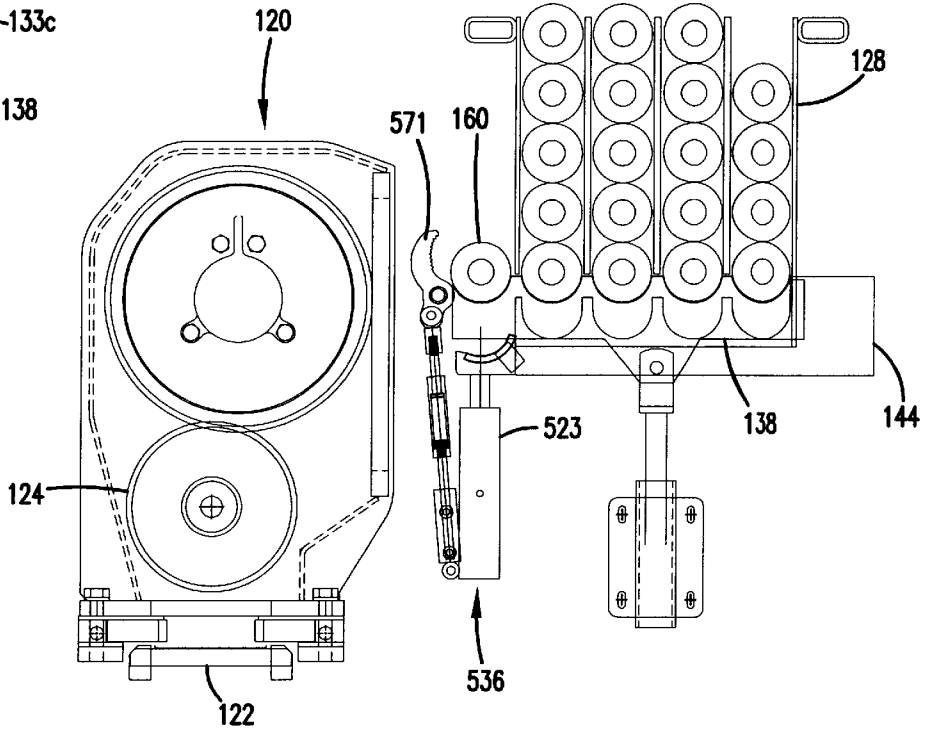
Figure 3C:
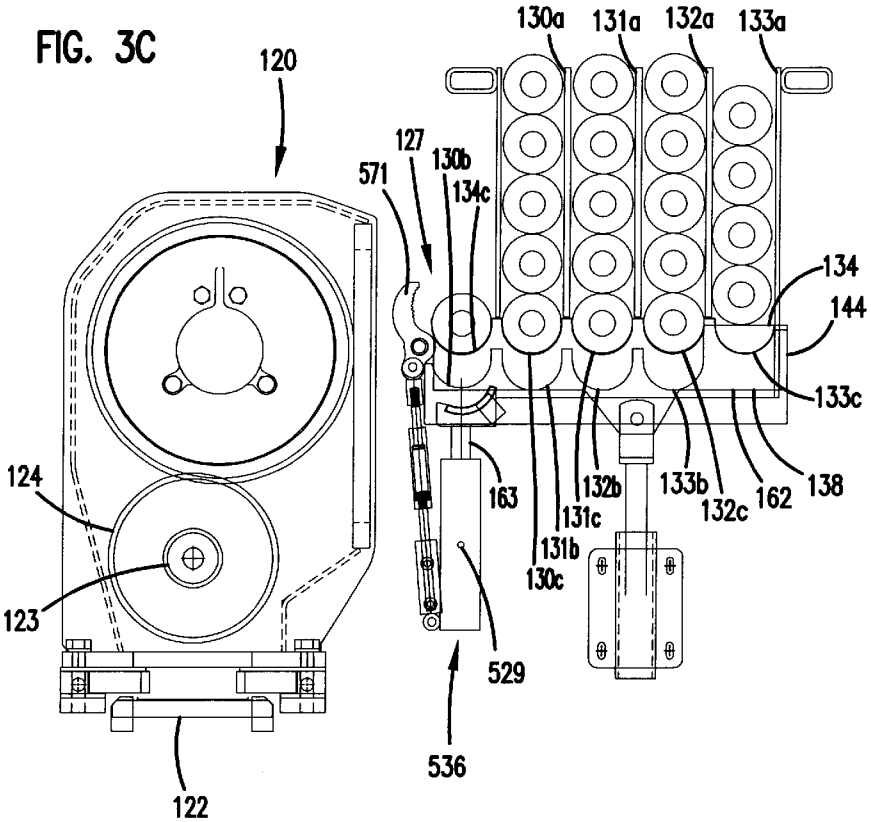
Figures 3E, 3F:
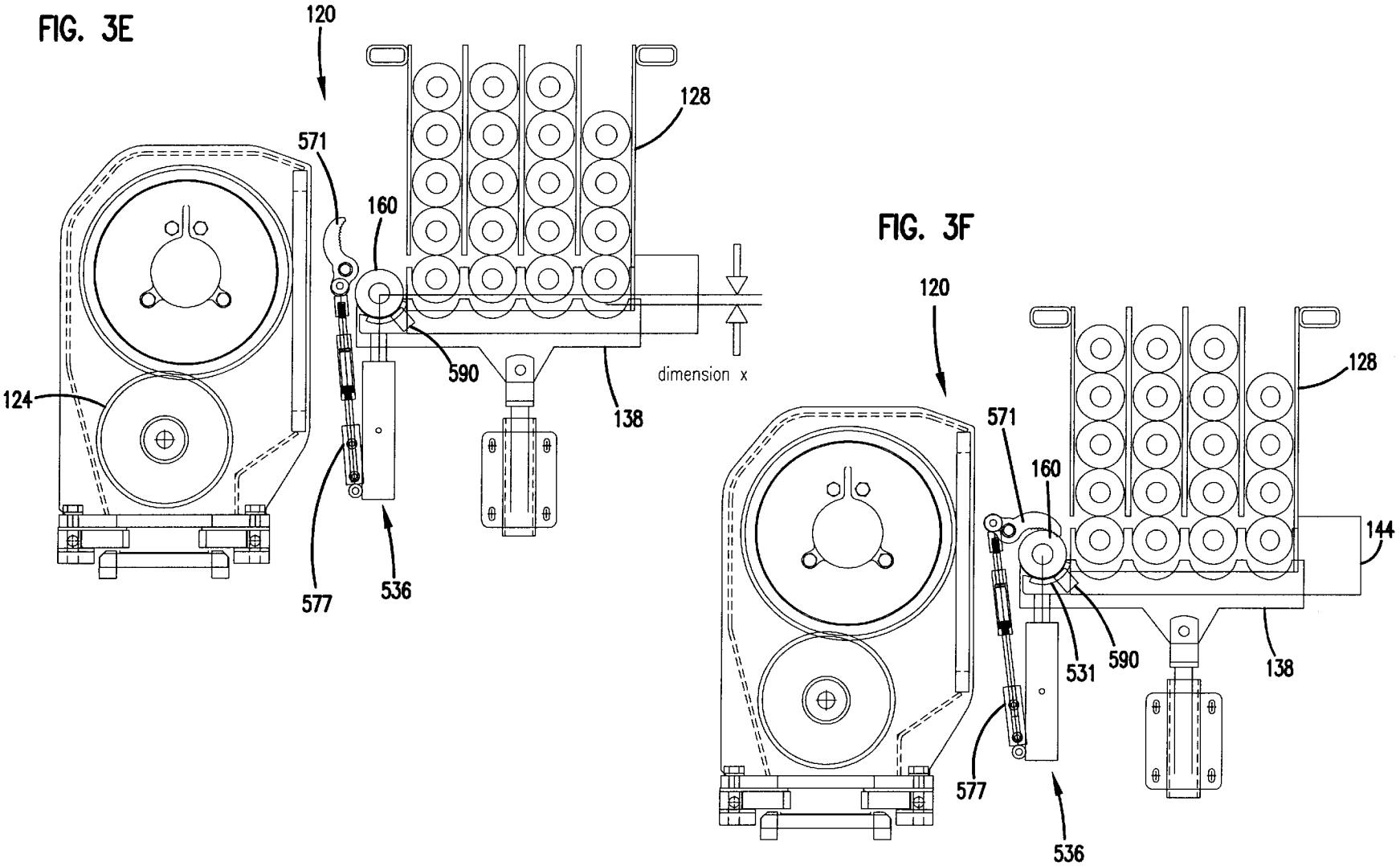

FIG. 3C shows the lift 138 in a raised orientation in which the lowermost row of rods is located within the magazine 128, and FIG. 3A shows the lift 138 in a lowered position in which the lowermost row of rods is located beneath the magazine. The lift 138 includes a top piece 162 that can be raised and lowered by any number of conventional structures (e.g., hydraulic cylinders, mechanical drives, electric actuators, hydraulic actuators, chain or belt drives, rack and pinion drives, etc.). The top piece 162 is preferably sized to extend at least beneath all of the columns 130*a*–133*a*. In the depicted embodiment, the top piece 162 also includes a portion 163 that extends beyond the rod box 128 at a location adjacent the "staging" location 127. While the top side of the top piece 162 could be flat or any other shape, the top side preferably defines five rod cradling recesses 130*c*–134*c*. When the rod box 128 is mounted on the directional drilling machine 120, the pipe cradling recesses 130*c*–133*c* respectively align beneath the columns 130*a*–133*a* of the rod box 128, and the fifth recess 134*c* is preferably located at the rod staging location 127.

Two of the transfer mechanisms 536 (only one shown) are preferably provided for transferring rods between the feed members 144 and the rotational driver 124 of the directional drilling machine 120. In FIGS. 3A–3L and 4A–4L, the second transfer mechanism is hidden behind the depicted transfer mechanism 536. For ease of description, only the depicted transfer mechanism 536 will be referenced throughout the remainder of the specification.

In FIGS. 3A–3L and 4A–4L, the pivot axis 529 of the transfer member 523 is shown below the bottom of the rod box 128. In alternative embodiments, the pivot axis 529 can be located at a variety of different locations. For example, the pivot axis 529 can be located above the bottom of the rod box 128. Additionally, in still other embodiments, the transfer member 523 need not pivot. For example, in one embodiment, the transfer member can comprise a shuttle that is linearly moved back and forth beneath the rod box. For such an embodiment, the retainer 571 can be pivotally connected to the shuttle at a location adjacent an end of the shuttle, and the retainer 531 can be formed by an end wall of the shuttle adapted to oppose the retainer 571 when the retainer 571 is in a rod retaining position.

III. Sequence for Moving a Rod from the Rod Box to the Rotational Driver

Figures 3G, 3H:
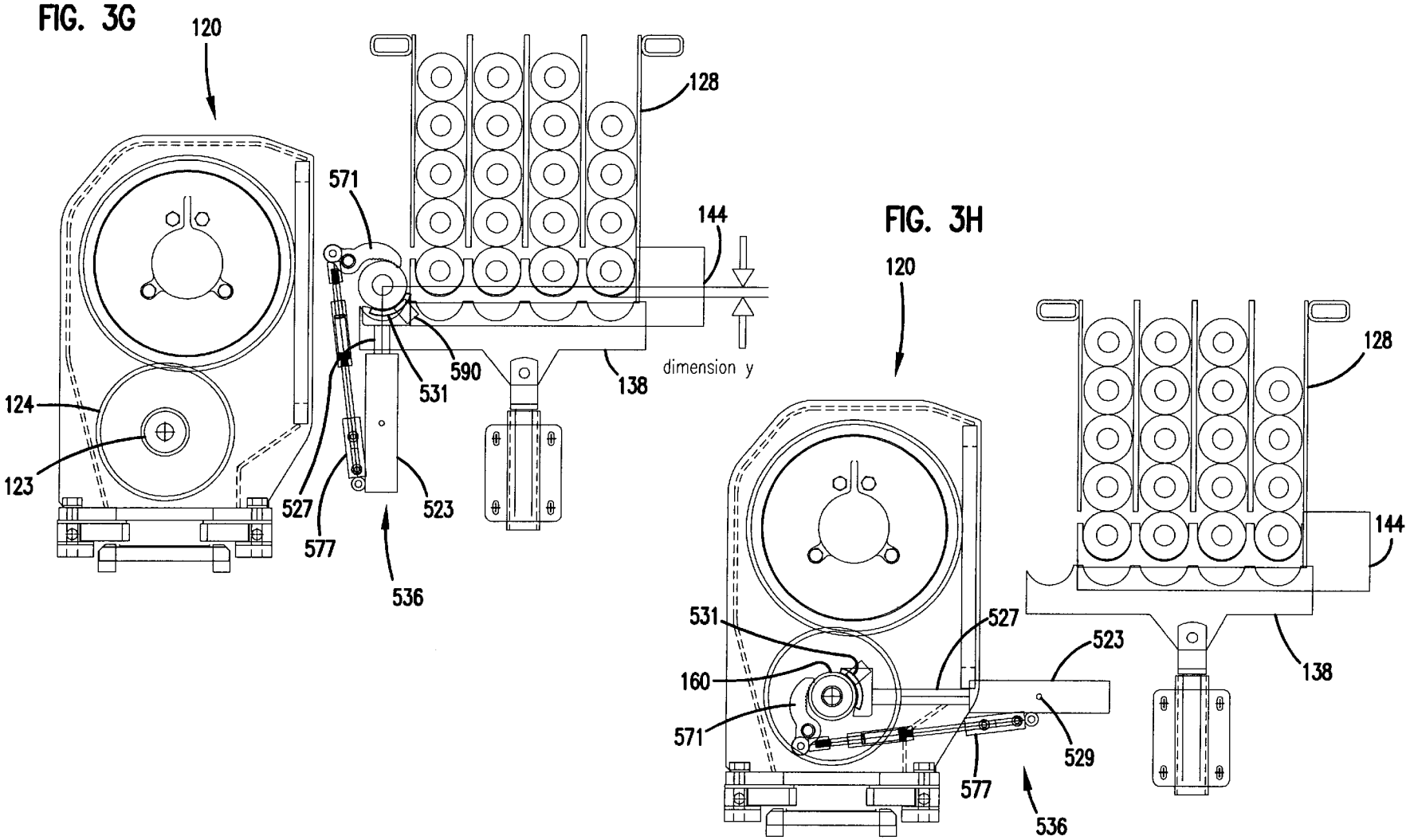
Figure 3J:
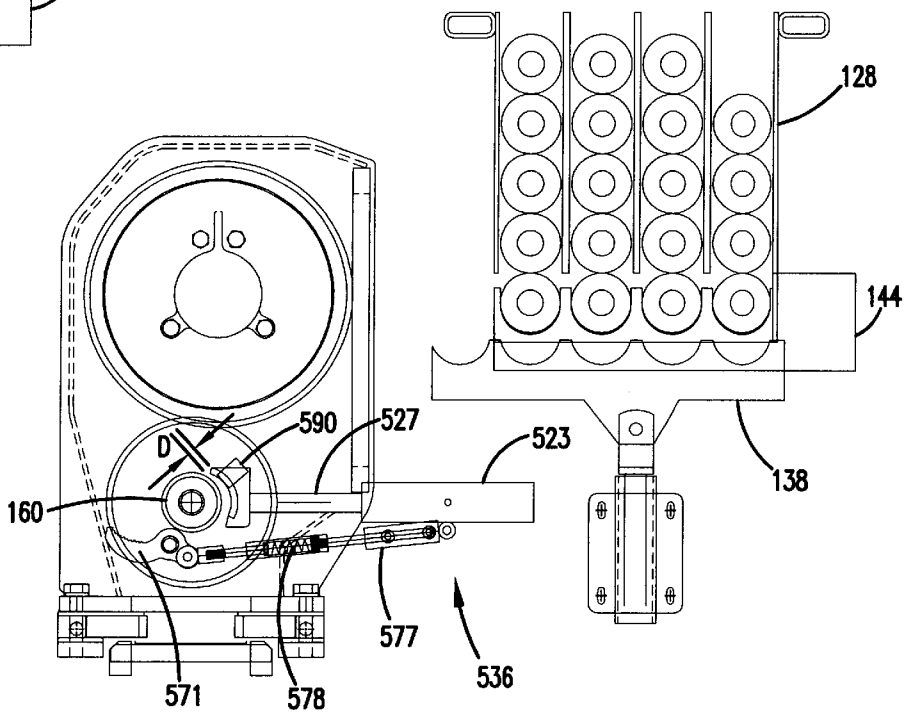
Figure 3I:
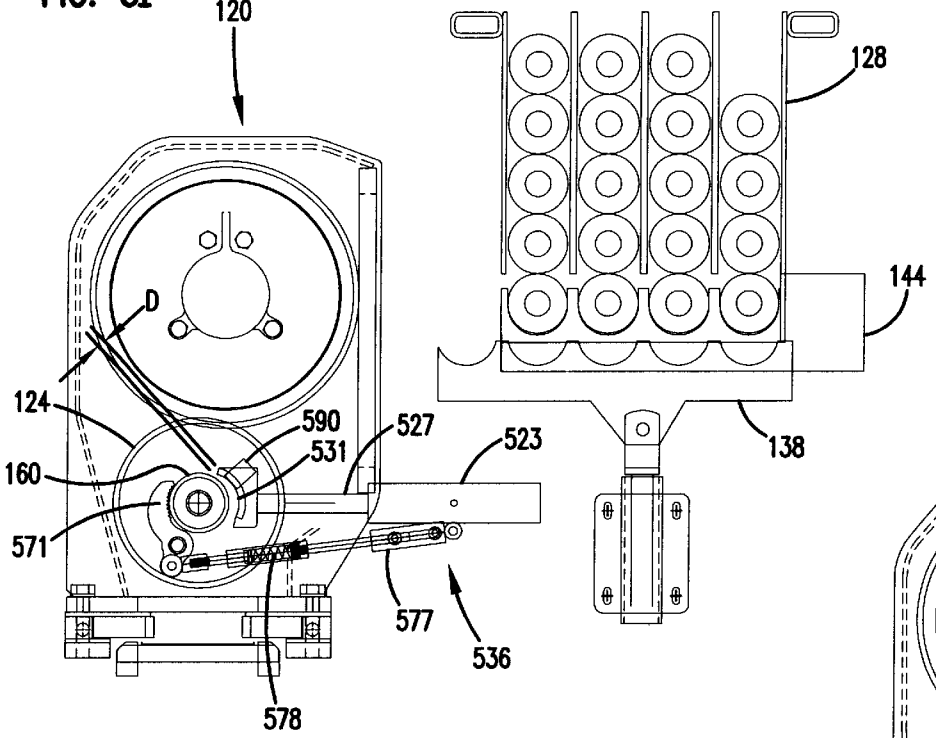

To move a rod from the rod box 128 to the rotational driver 124, the rod transfer member 523 is initially oriented in an upright orientation, the second retainer 571 is in the non-retaining position, the feed member 144 is in the retracted position and the lift 138 is in the lowered position (see FIG. 3A). To start the sequence, the feed member 144 is extended (i.e., moved one column width to the left) such that rod 160 is placed at the staging location 127 (see FIG. 3B). The lift 138 is then raised to lift the bottom-most row of rods from the feed member 144 (see FIG. 3C). With the rods raised, the feed member 144 is returned to the retracted position as shown in FIG. 3D. The lift 138 is then lowered at least a distance x (shown in FIG. 3E) that is sufficient to bring the rod 160 into the effective sensing zone of the sensor 590. Once the rod 160 is sensed, the cylinder 577 causes the second retainer 571 to pivot to the rod retaining position (see FIG. 3F) such that the rod 160 is held between the first and second retainers 531 and 571. As the second retainer 571 is pivoted toward the first retainer 531, the lift 138 continues its descent through an additional distance y until it reaches the fully lowered position as shown in FIG. 3G. The descent distance x+y is preferably sufficient for the lift 138 not to interfere with the pivotal movement of the transfer member 523. In the lowest position, the top side of the lift 138 is positioned lower than the bottoms of the pockets 130*b*–133*b* of the feed member 144. It will be appreciated that the distance x+y traveled by the lift 138 can be varied depending upon the type of transfer configuration used. For example, in certain embodiments, it may be desirable for the lift 138 to descend well below the feed members 144.

After the lift 138 has been fully lowered, the transfer member 523 is pivoted downward and the ram portion 527 is extended to place the rod 160 in co-axial alignment with the chuck 123 of the rotational driver 124 (see FIG. 3H). The rod 160 is then coupled to the chuck 123 and the drill string. After the rod 160 has been coupled to the chuck 123 and the drill string, the ram portion 527 of the transfer member 523 is retracted. Since the rod 160 is connected to the chuck 123, the rod 160 remains stationary as the ram portion 527 is retracted. Thus, movement of the ram portion 527 causes the second retainer 571 to contact the stationary rod 160 and pivot leftward. The pivotal movement of the second retainer 571 causes the spring 578 between the cylinder 577 and the second retainer 571 to compress. Once the ram portion 527 has been retracted the effective sensing distance D (see FIG. 3I), the sensor 590 stops detecting the rod 160 and the cylinder 577 is actuated causing the second retainer 571 to pivot the non-rod retaining position of FIG. 3J. It will be appreciated that by sensing the distance the rod is displaced relative to the sensor 590, the distance the transfer member 523 has been retracted is also sensed since these values are related.

Figure 3L:
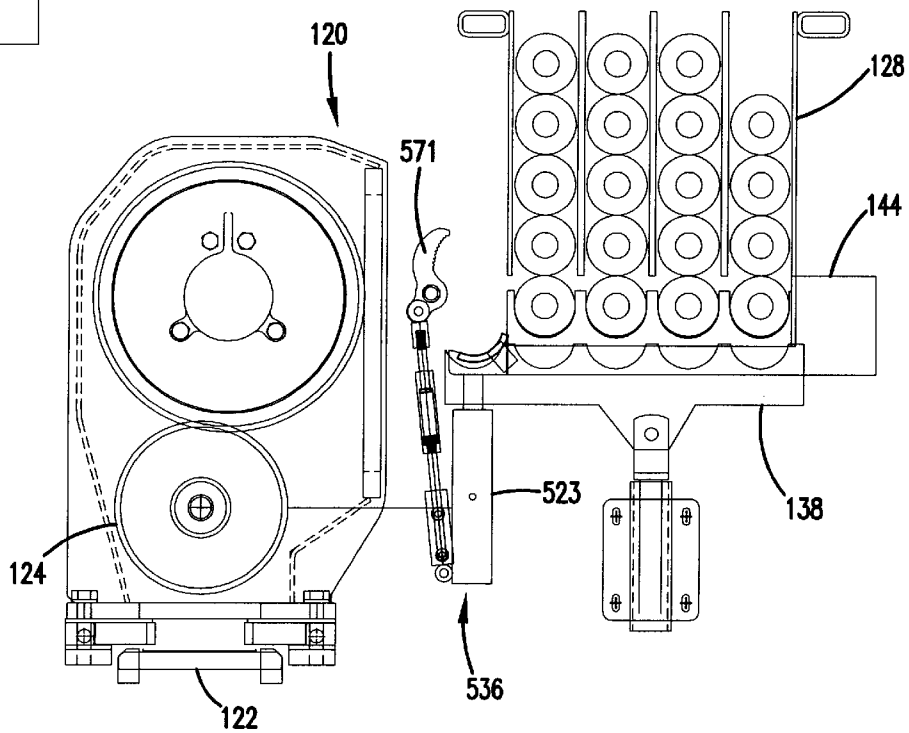
Figure 3K:
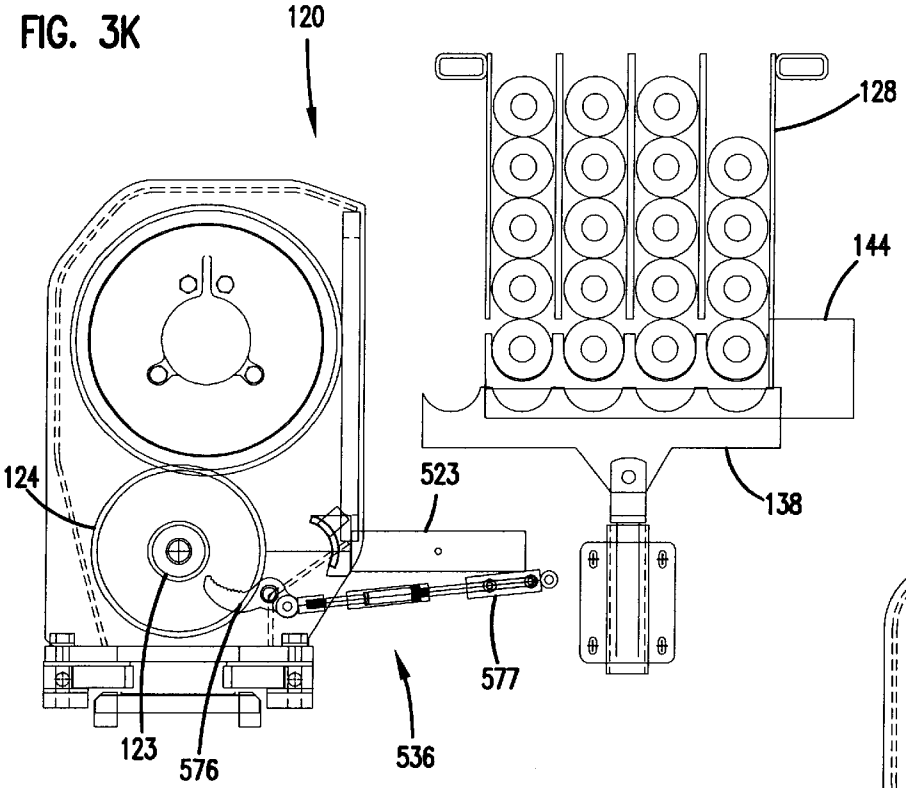

As the second retainer 571 is pivoted downward, the ram portion 527 continues to retract until it reaches the fully retracted position of FIG. 3K. Thereafter, the transfer member 523 is pivoted back to the upright position as shown in FIG. 3L. By repeating the above-described sequence, additional rods can be moved from the rod box 128 to the rotational driver 124.

IV. Sequence for Moving a Rod from the Rotational Driver to the Rod Box

Figure 4B:
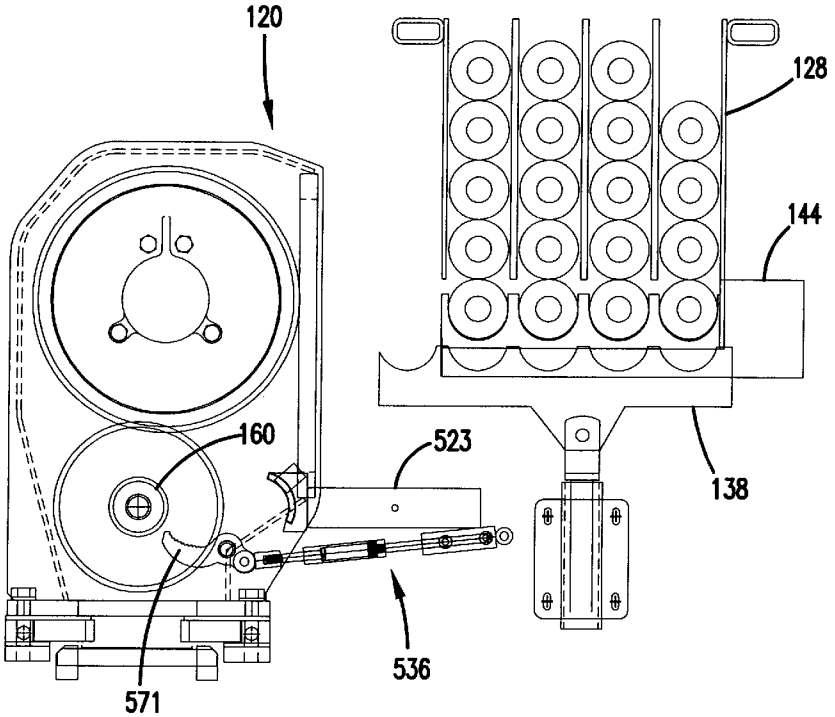
FIGS. 4A–4L illustrate a sequence for moving a rod from the rotational driver to the rod box of the directional drilling machine of FIGS. 3A–3L.
Figure 4A:
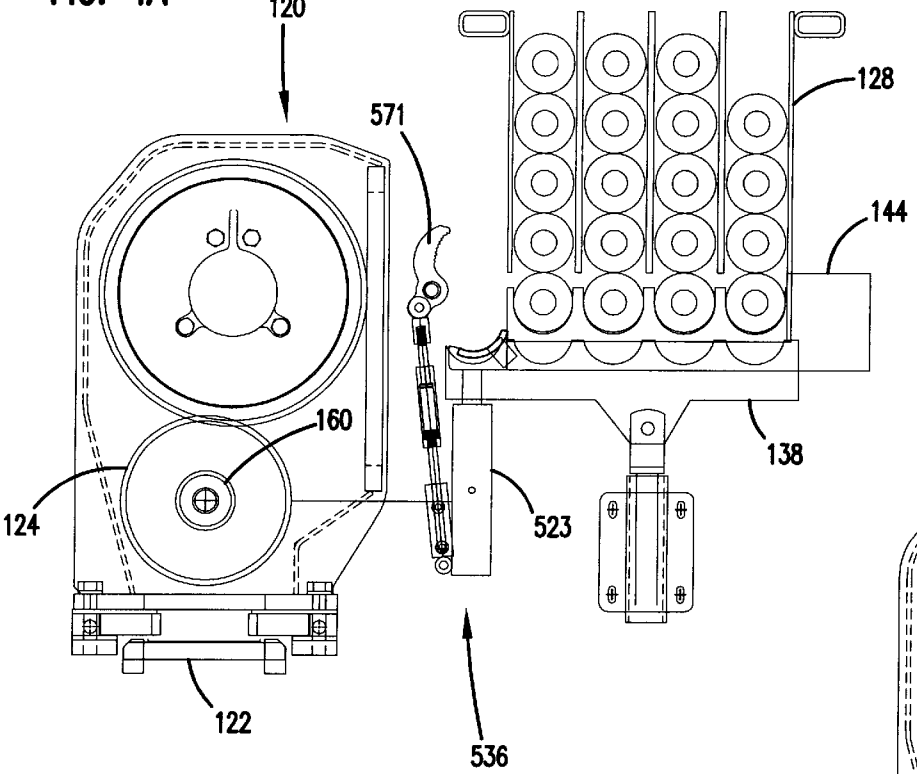
Figure 4D:
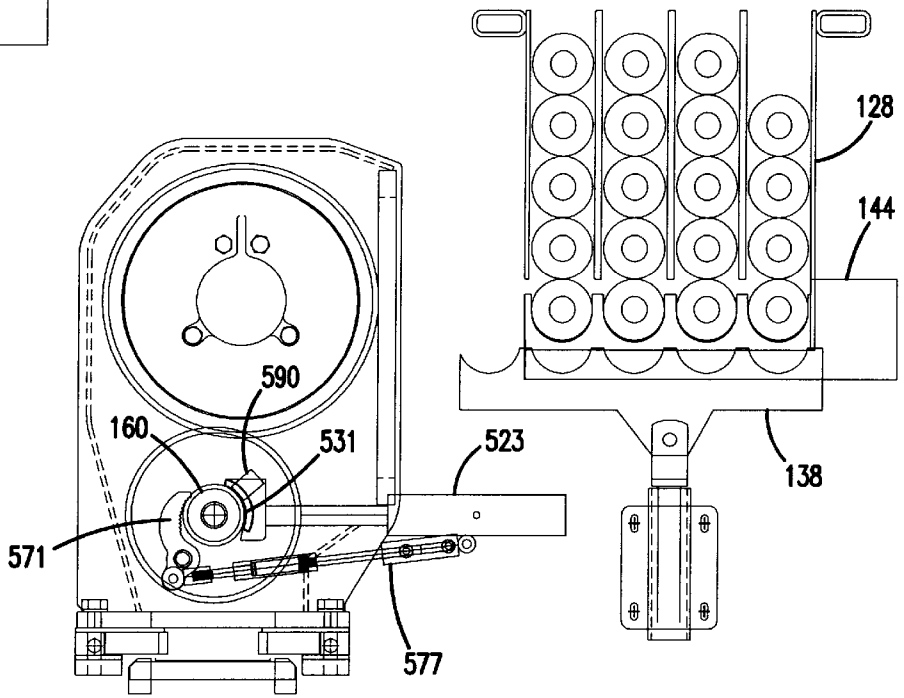
Figure 4C:
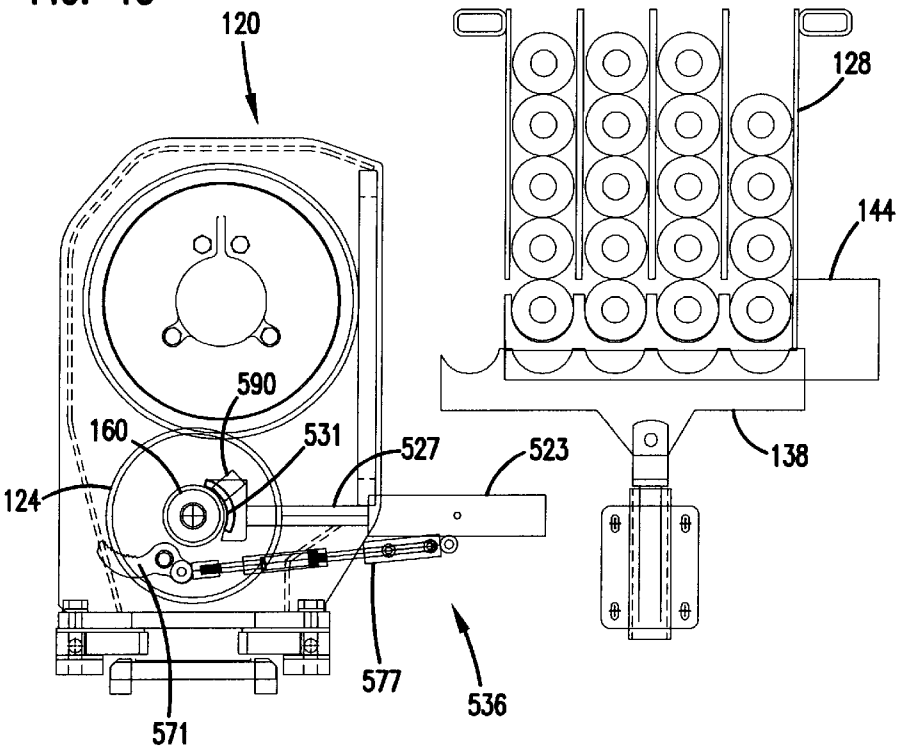

FIG. 4A shows the directional drilling machine 120 with the lift 138 in the lower position, the feed member 144 in the retracted position, the second retainer 571 is in the non-retaining position and the transfer member 523 in the upright position. To return a rod 160 from the rotational driver 124 to the rod box 128, the transfer member 523 is first pivoted downward as shown in FIG. 4B. The ram portion 527 is then extended toward the rod 160 at least until the rod is within the effective sensing zone of the sensor 590 (see FIG. 4C). Once the rod's presence is detected by the sensor 590, the cylinder 577 is signaled to move the second retainer 571 from the non-retaining position to the retaining position as shown in FIG. 4D. In this manner, the rod is retained between the first and second retainers 531 and 571. Next, the rod 160 is uncoupled from the chuck 123 and the drill string.

Figure 4F:
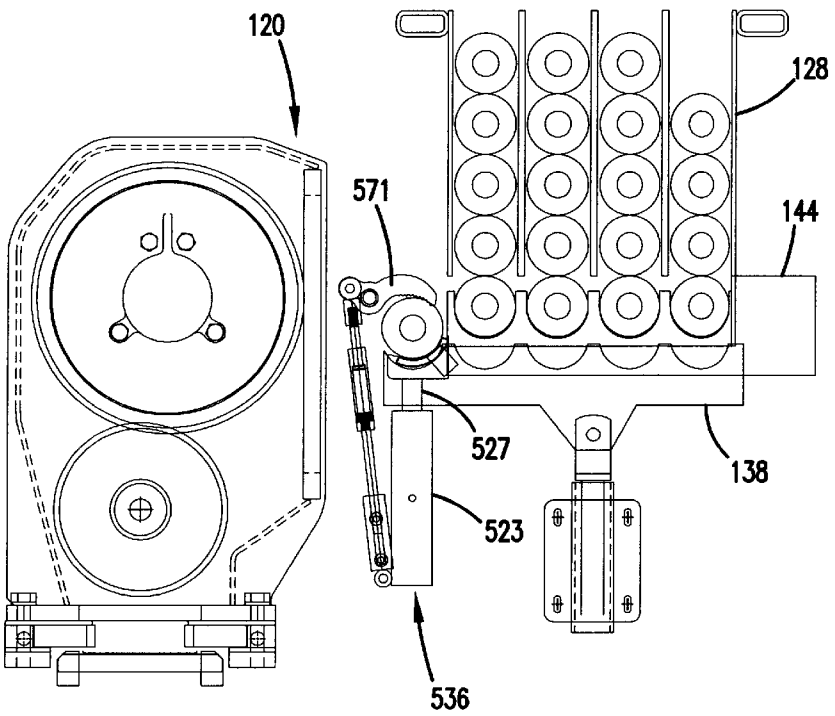
Figure 4E:
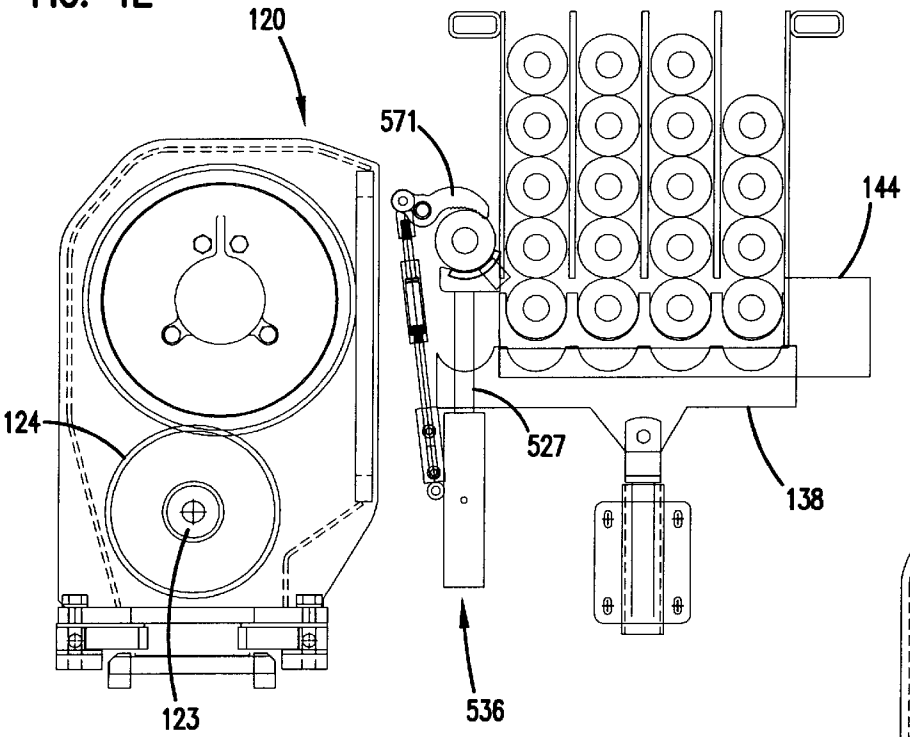
Figure 4H:
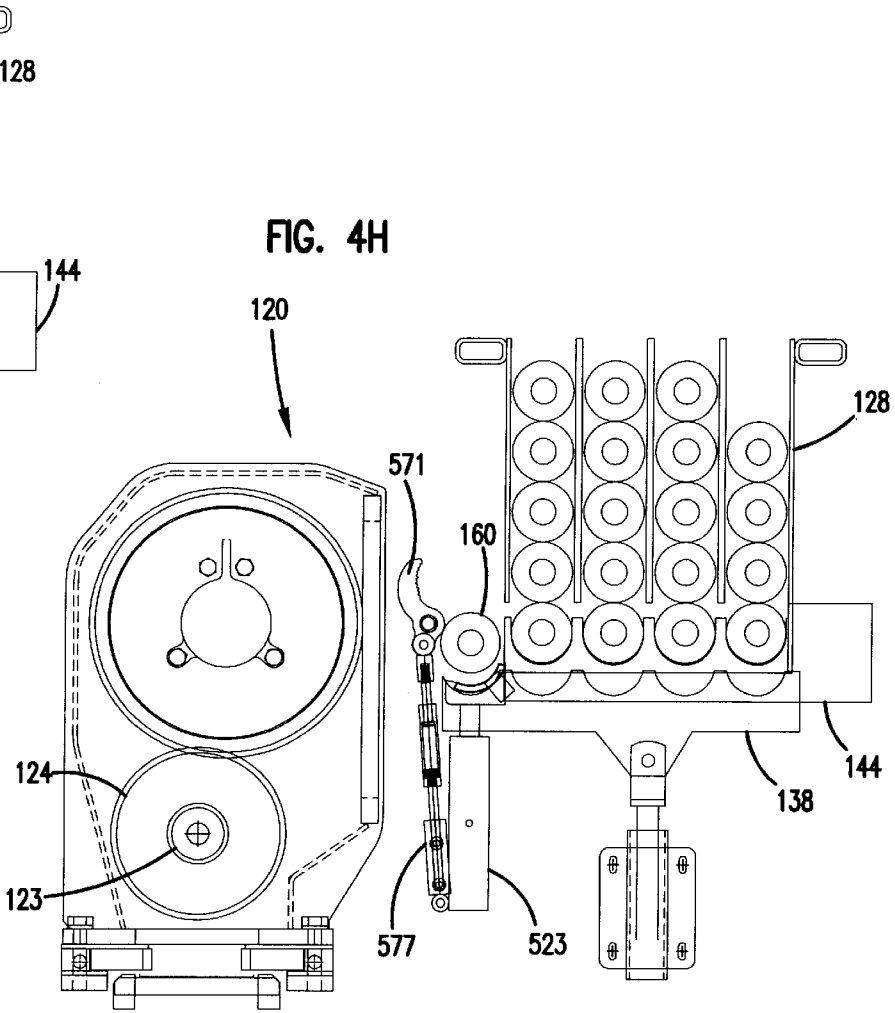
Figure 4G:
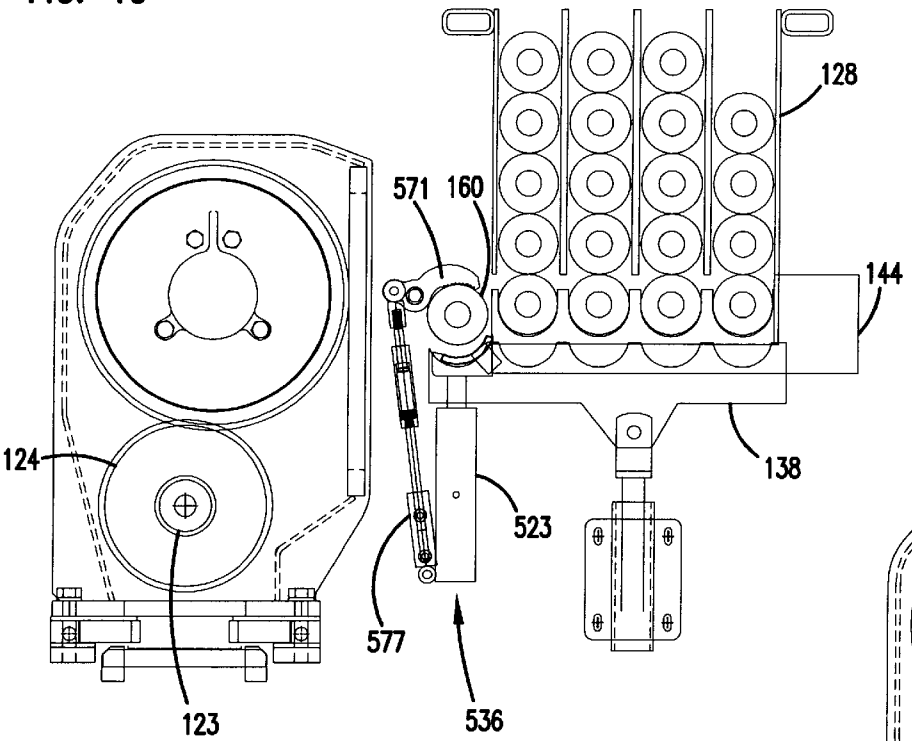
Figure 4J:
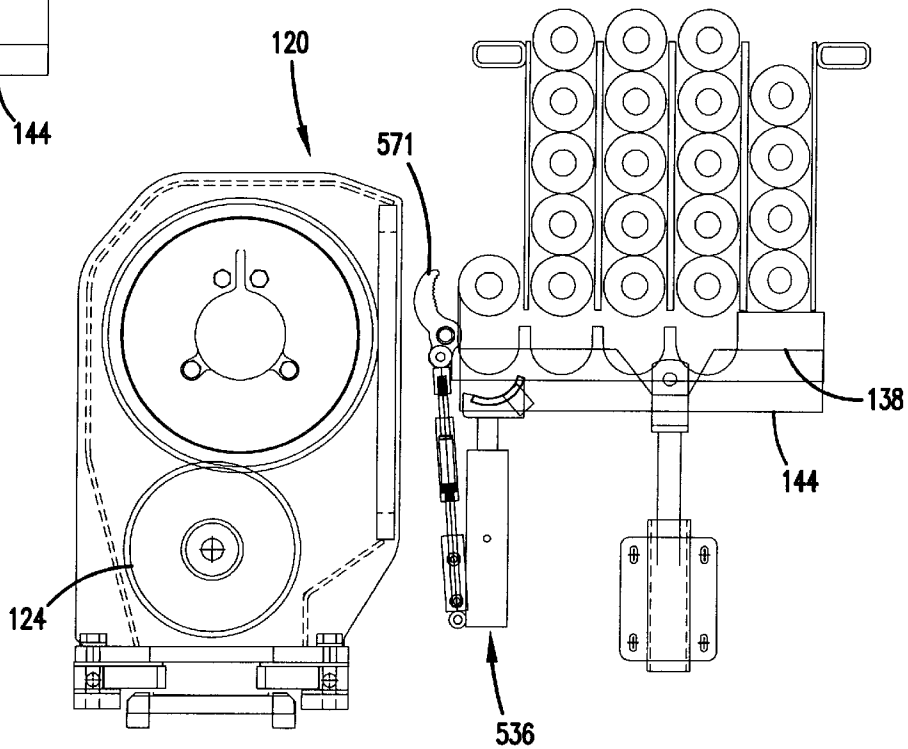
Figure 4I:
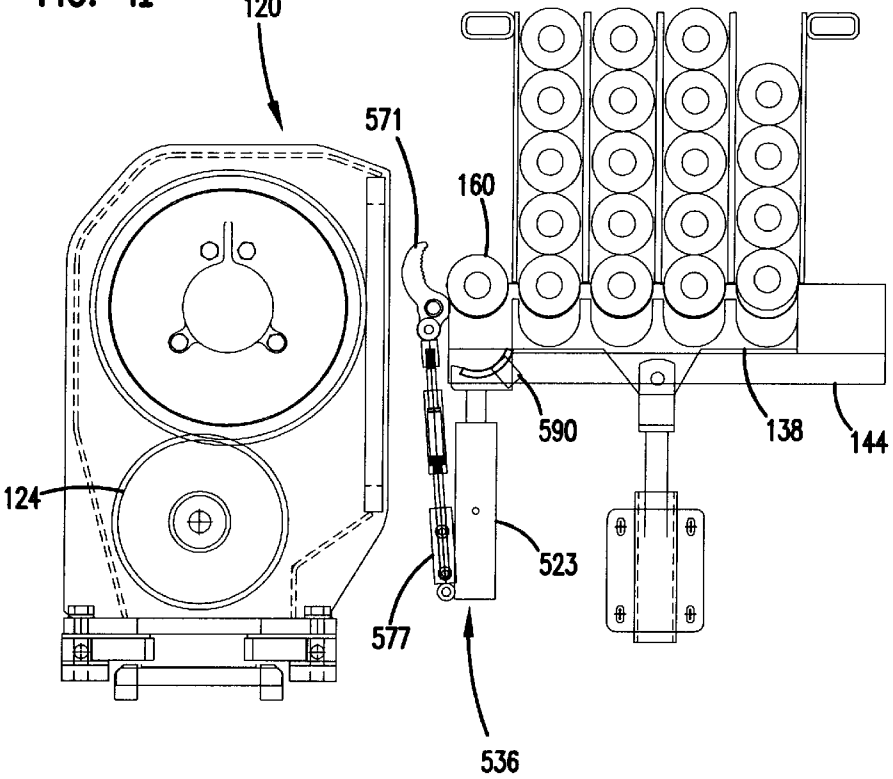
Figure 4L:
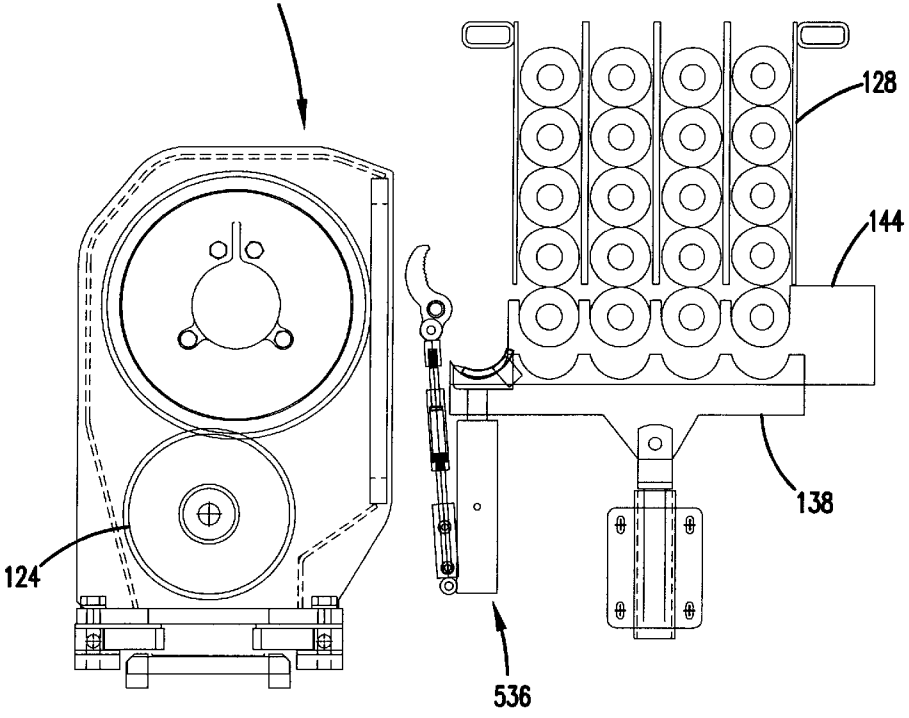
Figure 4K:
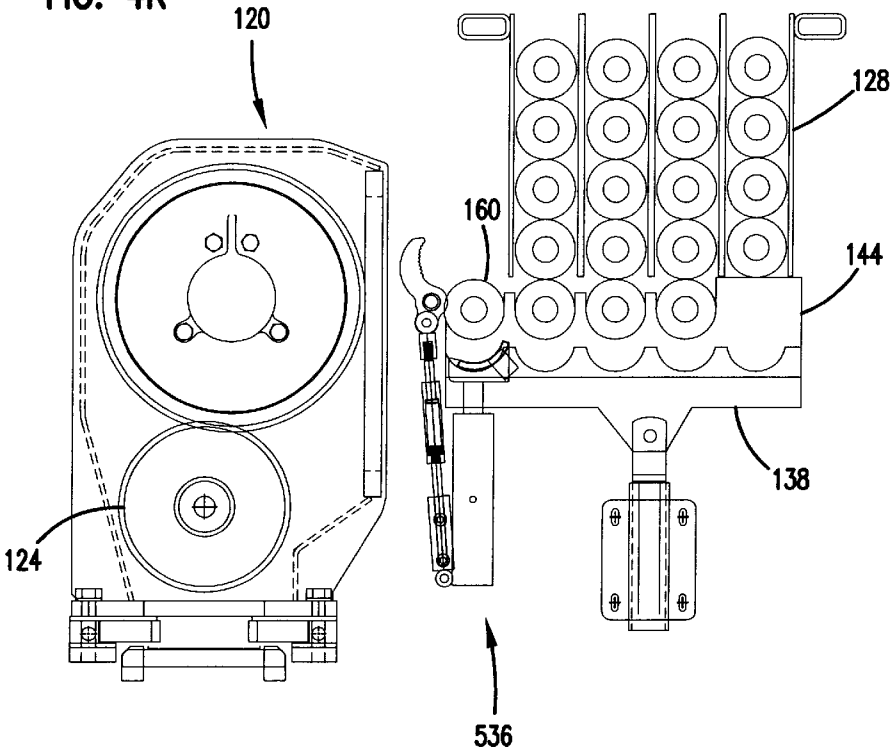

After the rod 160 has been uncoupled from the chuck 123 and the drill string, transfer member 523 is pivoted to the upright position, and the ram portion 527 is retracted (see FIGS. 4E and 4F). Upon fully retracting the ram portion 527, the lifter 138 is raised causing the rod to move upward against the bias of the second retaining member 571. Once the rod 160 is displaced from the first retainer 531 by a distance at least equal to the effective sensing distance d of the sensor (see FIG. 4G), the cylinder 577 is actuated causing the second retainer 571 to pivot to the non-retaining position (see FIG. 4H). Concurrently, the lifter 138 continues to rise (see FIG. 4I) until the lifter 138 reaches the full upper position of FIG. 4J. Thereafter, the feed member 144 is extended as shown in FIG. 4J, and the lifter 138 is lowered to place the rod 160 on the feed member 144 (see FIG. 4K). Finally, the feed member 144 is retracted to return the rod 160 beneath the rod box 128 (see FIG. 4L). By raising the lifter 138 at this time, the bottom row rods can be pushed back into the rod box 128. To return additional rods from the rotational driver 124 to the rod box 128, the above-described sequence can be repeated.

The above specification and examples provide a complete description of the manufacture and use of the composition of the invention. Since many embodiments of the invention can be made without departing from the spirit and scope of the invention, the invention resides in the claims hereinafter appended.

What is claimed is:

1. A horizontal directional drilling machine comprising:

a magazine for holding a plurality of elongated rods;

a rotational drive head;

a transfer mechanism for transferring rods from adjacent the magazine to adjacent the rotational drive head, the transfer mechanism including:

a first rod retainer defining a rod receiving location;

a second rod retainer that is moveable relative to the first rod retainer, the second rod retainer being movable between first and second positions, the second rod retainer being located closer to the first rod retainer when oriented in the first position than when oriented in the second position;

a proximity sensor for detecting when a rod is located at the rod receiving location;

an actuator that moves the second rod retainer to the first position when a rod is detected by the sensor at the rod receiving location, and that moves the second rod retainer to the second position when a rod is not detected by the sensor at the rod receiving location; and a spring operatively connected between the actuator and the second rod retainer that allows the second rod retainer to move through at least a limited range of movement relative to the actuator, the limited range of movement having a distance greater than an effective sensing distance of the proximity sensor.

2. A horizontal directional drilling machine comprising:

a magazine for holding a plurality of elongated rods;

a rotational drive head;

a transfer mechanism for transferring rods from adjacent the magazine to adjacent the rotational drive head, the transfer mechanism including:

a transfer member defining a rod receiving location;

a rod retainer, the rod retainer being moveable between a first position where the rod retainer is oriented to retain a rod at the rod receiving location and a second position in which the rod can be removed from or inserted into the rod receiving location;

a proximity sensor for detecting when a rod is located at the rod receiving location;

an actuator that moves the rod retainer to the first position when a rod is detected by the sensor at the rod receiving location, and that moves the rod retainer to the second position when a rod is not detected by the sensor at the rod receiving location; and a spring operatively connected between the rod retainer and the actuator that allows the rod retainer to move through at least a limited range of movement relative to the actuator, the limited range of movement having a distance greater than an effective sensing distance of the proximity sensor.

3. The horizontal directional drilling machine of claim 2, wherein the spring allows the rod retainer to move relative to the actuator to an intermediate position located between the first and second positions.

4. The horizontal directional drilling machine of claim 3, wherein the spring biases the rod retainer toward the first position.

5. A horizontal directional drilling machine comprising:

a magazine for holding a plurality of elongated rods;

a rotational drive head;

a transfer mechanism for transferring rods from adjacent the magazine to adjacent the rotational drive head, the transfer mechanism including:

a transfer member defining rod receiving location;

a rod retainer moveable relative to the transfer member between a first position where the rod retainer is oriented to retain a rod at the rod receiving location and a second position in which the rod can be removed from or inserted into the rod receiving location;

a proximity sensor for detecting when a rod is located at the rod receiving location;

a drive cylinder that moves the rod retainer between the first and second positions; and a spring operatively connected between the rod retainer and the drive cylinder that allows the rod retainer to move through at least a limited range of movement relative to the drive cylinder, the limited range of movement having a distance greater than an effective sensing distance of the proximity sensor.

6. The horizontal directional drilling machine of claim 5, wherein the drive cylinder comprises a hydraulic cylinder.

7. A horizontal directional drilling machine comprising:

a magazine for holding a plurality of elongated rods;

a rotational drive head;

a transfer mechanism for transferring rods from adjacent the magazine to adjacent the rotational drive head, the transfer mechanism including a transfer member defining a rod receiving location;

a rod retainer moveable relative to the transfer member between a first position where the rod retainer is oriented to retain a rod at the rod receiving location and a second position in which the rod can be removed from or inserted into the rod receiving location;

an actuator that moves the rod retainer between the first position and second positions;

the rod retainer being moveable from the first position to an intermediate position independent of the actuator being actuated, the intermediate position being between the first and second positions;

wherein, when the rod retainer is moved from the first position to the intermediate position through contact with a rod positioned at the rod receiving location, the actuator is caused to be actuated such that the rod retainer moves to the second position.

8. A method for moving a rod to a drill string of a horizontal drilling machine, the method comprising:

providing a transfer mechanism including: a transfer member having a rod receiving location; and a rod retainer moveable from a first position where the rod retainer is adapted to retain a rod at the rod receiving location and a second position in which the rod can be removed from or inserted into the rod receiving location;

retaining a rod in the rod receiving location by moving the rod retainer to the first position moving the transfer member to bring the rod in alignment with a drill string;

connecting the rod to the drill string;

moving the transfer member away from the drill string thereby causing the rod to force the rod retainer from the first position toward the second position;

moving the rod retainer toward the second position in response to the force applied by the rod;

detecting when the transfer member has been moved a predetermined distance relative to the rod; and causing an actuator to move the rod retainer to the second position when it is detected that the transfer member has been moved the predetermined distance relative to the rod.

9. A loading/unloading device comprising:

a magazine for holding a plurality of elongated rods, the magazine including a plurality of columns in which the rods are held, each of the columns having a separate bottom opening;

a feed member for feeding the rods to and from the magazine, the feed member including at least one upwardly opening pocket sized for receiving the rods, the feed member being moveable from a retracted position in which the pocket is located beneath the magazine to a staging position in which the pocket is laterally offset from the magazine; and a lift unit for loading the magazine by lifting the rods from the pocket of the feed member up through the bottom openings of the columns, the lift unit including a first portion that extends beneath all of the columns of the magazine and a second portion that projects laterally outward from beneath the columns to adjacent the staging position, the lift being moveable through a range of travel that is sufficiently long for the second portion of the lift to: 1) lift a rod held at the staging position by the feed member to a location above the feed member; and 2) lower the rod below the pocket of the feed member after the feed member has been returned to the retracted position.

10. The loading/unloading device of claim 9 wherein the feed member includes a plurality of upwardly opening pockets.

* * * * *